US009103110B1

(12) United States Patent
Gerber

(10) Patent No.: US 9,103,110 B1
(45) Date of Patent: Aug. 11, 2015

(54) GEO SHELTER

(71) Applicant: Scott L. Gerber, Sarasota, FL (US)

(72) Inventor: Scott L. Gerber, Sarasota, FL (US)

( * ) Notice: Subject to any disclaimer, the term of this patent is extended or adjusted under 35 U.S.C. 154(b) by 0 days.

(21) Appl. No.: 14/529,144

(22) Filed: Oct. 31, 2014

Related U.S. Application Data

(60) Provisional application No. 61/897,240, filed on Oct. 30, 2013.

(51) Int. Cl.

| | |
|---|---|
| ***E04H 1/00*** | (2006.01) |
| ***E04B 1/32*** | (2006.01) |
| ***E04B 1/343*** | (2006.01) |
| ***E04C 2/38*** | (2006.01) |
| ***E04B 2/00*** | (2006.01) |
| ***E04C 2/54*** | (2006.01) |
| ***E04G 21/14*** | (2006.01) |
| ***E04H 1/02*** | (2006.01) |

(52) U.S. Cl.
CPC ..... *E04B 1/3211* (2013.01); *E04B 1/34321* (2013.01); *E04B 1/34363* (2013.01); *E04C 2/38* (2013.01); *E04C 2/46* (2013.01); *E04C 2/54* (2013.01); *E04G 21/14* (2013.01); *E04H 1/02* (2013.01); *E04B 2001/327* (2013.01); *E04B 2001/3223* (2013.01); *E04B 2001/3294* (2013.01)

(58) Field of Classification Search
CPC ..... E04B 1/3211; E04B 1/32; E04B 1/3205; E04B 2001/3223
USPC ..... 52/79.4, 79.1, 80.1
See application file for complete search history.

(56) References Cited

U.S. PATENT DOCUMENTS

| | | | | | |
|---|---|---|---|---|---|
| 1,092,217 | A | * | 4/1914 | Hopkins | 446/102 |
| 1,292,188 | A | * | 1/1919 | Wheeler | 446/85 |
| 1,347,808 | A | * | 7/1920 | Franklin | 403/119 |
| 1,362,238 | A | * | 12/1920 | Dietz | 52/646 |
| 2,918,992 | A | * | 12/1959 | Gelsavage | 52/81.1 |
| 2,970,388 | A | * | 2/1961 | Yonkers | 434/277 |
| 3,344,565 | A | * | 10/1967 | Nye | 52/81.3 |
| 3,600,825 | A | * | 8/1971 | Pearce | 434/403 |
| 3,600,844 | A | * | 8/1971 | Simpson | 446/118 |
| 3,608,906 | A | * | 9/1971 | Odier | 273/157 R |
| 3,659,360 | A | * | 5/1972 | Zeischegg | 434/403 |
| 3,722,153 | A | * | 3/1973 | Baer | 52/81.2 |
| 3,726,027 | A | * | 4/1973 | Cohen et al. | 434/98 |
| 3,830,011 | A | * | 8/1974 | Ochrymowich | 446/126 |
| 3,939,581 | A | * | 2/1976 | Clarke, Jr. | 434/278 |
| 3,940,100 | A | * | 2/1976 | Haug | 248/188.1 |
| 3,953,948 | A | * | 5/1976 | Hogan | 52/81.4 |
| 4,055,019 | A | * | 10/1977 | Harvey | 446/115 |
| 4,129,975 | A | * | 12/1978 | Gabriel | 52/655.2 |
| 4,183,167 | A | * | 1/1980 | Jatich | 446/118 |

(Continued)

*Primary Examiner* — Mark Wendell
*Assistant Examiner* — Keith Minter
(74) *Attorney, Agent, or Firm* — Dorothy S. Morse

(57) ABSTRACT

A temporary or permanent shelter in kit form having extruded interlocking panels that easily clip together to create the general shape of a geodesic dome. The kits can be stored in a very small space when not assembled, and are primarily contemplated for use in emergencies and disaster relief. The sides of panels can be color-coded for fast and accurate assembly. Light-transmitting panels, reinforced panels, and entrance structures can also be used according to need. Furthermore, multiple kits can be can be transported at once by helicopter when roads are not available, they are easily and quickly constructed and disassembled, and are made from strong extruded and composite materials that do not mold or burn.

8 Claims, 3 Drawing Sheets

(56) References Cited

U.S. PATENT DOCUMENTS

| | | | | | |
|---|---|---|---|---|---|
| 4,271,628 | A | * | 6/1981 | Barlow | 446/126 |
| 4,274,222 | A | * | 6/1981 | Zahn et al. | 446/126 |
| 4,287,690 | A | * | 9/1981 | Berger et al. | 52/81.4 |
| 4,290,244 | A | * | 9/1981 | Zeigler | 52/81.3 |
| 4,317,653 | A | * | 3/1982 | Wahl | 434/211 |
| 4,491,437 | A | * | 1/1985 | Schwartz | 403/172 |
| 4,558,551 | A | * | 12/1985 | Sevelinge et al. | 52/646 |
| 4,603,519 | A | * | 8/1986 | Lew et al. | 52/81.2 |
| 4,637,805 | A | * | 1/1987 | Sweetin | 446/71 |
| 4,701,131 | A | * | 10/1987 | Hildebrandt et al. | 434/211 |
| 4,711,062 | A | * | 12/1987 | Gwilliam et al. | 52/646 |
| 4,736,551 | A | * | 4/1988 | Higson | 52/81.4 |
| 4,864,795 | A | * | 9/1989 | Burg | 52/646 |
| 4,878,286 | A | * | 11/1989 | Coppa | 29/467 |
| 4,933,187 | A | * | 6/1990 | Schneider | 424/497 |
| RE33,710 | E | * | 10/1991 | Zeigler | 52/653.1 |
| 5,190,305 | A | * | 3/1993 | Putman | 280/79.3 |
| 5,228,258 | A | * | 7/1993 | Onoda et al. | 52/646 |
| 5,390,452 | A | * | 2/1995 | Eckert | 52/71 |
| 5,487,479 | A | * | 1/1996 | Pech et al. | 212/270 |
| 5,556,219 | A | * | 9/1996 | Mason | 403/176 |
| 5,566,516 | A | * | 10/1996 | Beaulieu | 52/81.3 |
| 5,611,187 | A | * | 3/1997 | Jones | 52/646 |
| 5,732,514 | A | * | 3/1998 | Organ | 52/81.1 |
| 5,921,049 | A | * | 7/1999 | Sugiyama | 52/653.1 |
| 5,961,365 | A | * | 10/1999 | Lambert | 446/125 |
| 6,032,430 | A | * | 3/2000 | Soukup | 52/656.9 |
| 6,055,999 | A | * | 5/2000 | Grey | 135/147 |
| 6,076,770 | A | * | 6/2000 | Nygren et al. | 244/159.5 |
| 6,282,849 | B1 | * | 9/2001 | Tuczek | 52/81.1 |
| 6,374,843 | B1 | * | 4/2002 | Zou | 135/145 |
| 6,379,212 | B1 | * | 4/2002 | Miller | 446/85 |
| 6,478,649 | B1 | * | 11/2002 | Hoback | 446/85 |
| 6,641,453 | B1 | * | 11/2003 | Morales et al. | 446/126 |
| 6,729,244 | B2 | * | 5/2004 | Cattaneo | 108/155 |
| 6,921,314 | B2 | * | 7/2005 | Miller | 446/85 |
| 6,965,075 | B2 | * | 11/2005 | Suzuki | 174/50 |
| 7,013,608 | B2 | * | 3/2006 | Newland | 52/146 |
| 7,028,442 | B2 | * | 4/2006 | Merrifield | 52/651.1 |
| 7,033,286 | B2 | * | 4/2006 | Morgan et al. | 473/383 |
| 7,641,534 | B2 | * | 1/2010 | Holman | 446/85 |
| 7,992,353 | B2 | * | 8/2011 | Athan | 52/81.3 |
| 8,011,849 | B2 | * | 9/2011 | Williams | 403/403 |
| 8,069,632 | B2 | * | 12/2011 | Li | 52/646 |
| 8,082,938 | B2 | * | 12/2011 | Prusmack | 135/135 |
| 8,087,671 | B2 | * | 1/2012 | Houlis | 273/153 S |
| 8,096,085 | B2 | * | 1/2012 | Schneider et al. | 52/81.3 |
| 2002/0083675 | A1 | * | 7/2002 | Hoberman | 52/645 |
| 2002/0088185 | A1 | * | 7/2002 | Miller | 52/81.4 |
| 2003/0140589 | A1 | * | 7/2003 | Yamawaki | 52/646 |
| 2004/0253902 | A1 | * | 12/2004 | Sinisi | 446/85 |
| 2005/0245167 | A1 | * | 11/2005 | Sinisi | 446/85 |
| 2006/0080929 | A1 | * | 4/2006 | Lima | 52/637 |
| 2008/0040984 | A1 | * | 2/2008 | Lanahan | 52/79.9 |
| 2008/0136921 | A1 | * | 6/2008 | Hernandez | 348/207.99 |
| 2008/0187899 | A1 | * | 8/2008 | Cabrera | 434/403 |
| 2010/0067977 | A1 | * | 3/2010 | Bishop | 403/171 |
| 2010/0139192 | A1 | * | 6/2010 | Ng et al. | 52/309.1 |
| 2010/0192506 | A1 | * | 8/2010 | Allred et al. | 52/655.1 |

* cited by examiner

GEO SHELTER

CROSS-REFERENCES TO RELATED APPLICATIONS

This invention relates to the subject matter in U.S. provisional patent application 61/897,240 filed by the same inventor on Oct. 30, 2013, having the title of "Geo Shelter". Since the U.S. utility patent application herein is being filed before the end of the 1-year term of his U.S. provisional patent application 61/897,240, the applicant herein respectfully request a grant of domestic priority for his U.S. utility patent application herein based upon the Oct. 30, 2013, filing date of his U.S. provisional patent application 61/897,240.

BACKGROUND

1. Field of the Invention

This invention relates to emergency and disaster relief shelters, specifically to temporary or permanent housing in the general form of a geodesic dome that can be easily transported by helicopter to an emergency or disaster relief site even when roads are not passable or available, can be easily and quickly constructed and disassembled, is made from materials that do not mold or burn, and can be stored in a very small space when not assembled.

2. Description of the Related Art

For family shelter during and after emergencies and disaster relief, the United States government currently uses trailers each costing between $50,000 and $100,000. Disadvantages of such trailers include their high cost, the large amount of storage space they require when not in use, and the fact that roads are needed to transport them to an emergency or disaster site. In contrast, the present invention is in the kit form and compactly stored when not in use. Approximately twenty-four 600-square-foot unassembled present invention geo shelter kits can be stored in the footprint of one U.S. government emergency trailer, such as an 8-foot by 32-foot travel trailer. Also, each present invention panel used to assemble one of the domes weighs approximately one-and-one-half pounds, allowing one Blackhawk helicopter to lift approximately nine present invention kits (each for the assembly of a 600-square foot present invention dome) at once for transport to a disaster site, and the cost for each present invention geodesic dome shaped shelter kit is only about twenty percent of that of a new U.S. government emergency trailer. As the present invention panels clip together, no tools are needed for assembly of the present invention temporary geo shelters. However, should a panel need to be removed for repair or replacement, a small tool may be used to pop open the clips holding it in place and release the panel in need of repair or replacement. In addition, the panels are made of composite and extruded materials that do not mold or burn, an advantage over the U.S. government trailers, and it only takes about two hours to open a present invention kit and use it to assemble a 600-square-foot shelter. Although present invention geodesic dome shaped shelters can be used as a source of temporary housing, they can also be constructed on (and anchored to) an appropriate foundation and used as permanent housing. No other temporary shelter for emergencies and disaster relief is known that functions in the same manner as the present invention, has the same structure disclosed herein, or provides all of its important advantages.

BRIEF SUMMARY OF THE INVENTION

It is the primary object of this invention to provide a low-cost shelter for use in emergencies and disaster relief operations, which can even be transported into a disaster area inaccessible by roads. It is a further object of this invention to provide a shelter for use in emergencies and disaster relief operations that is easy and quick to assemble by non-skilled labor. Another object of this invention is to provide a shelter for use in emergencies and disaster relief operations that is made from strong materials that do not mold or burn. It is also an object of this invention to provide a shelter for use in emergencies and disaster relief operations having an interior space of at least five-hundred-square-feet. A further object of this invention is to provide a shelter for use in emergencies and disaster relief operations that can be stored in a very small space when it is unassembled.

The present invention, when properly made and used, provides a shelter for use in emergencies and disaster relief operations that is sufficiently compact when unassembled that approximately twenty-four of them can fit in the same footprint as one U.S. government emergency trailer. Since the present invention is in kit form and each panel only weighs approximately one-and-one-half pounds, one Blackhawk helicopter can lift approximately nine present invention kits at a time and take the present invention emergency and disaster relief shelters into areas inaccessible by roads. In addition, since the present invention geo shelters are made from panels clipped to one another, assembly of a six-hundred-square-foot shelter can occur in approximately two hours. Furthermore, although present invention geodesic dome shaped shelters can be used as a source for temporary housing, they can also be constructed on (and anchored to) an appropriate foundation and used as permanent or long-term housing. The general shape of its geodesic dome, the strong materials from which the present invention shelter is made, and appropriate anchoring to a foundation, makes the present invention stronger when exterior pressure is applied, instead of it weakening and experiencing premature deterioration as a result of exposure to inclement weather.

COMPONENT LIST

1—most preferred embodiment of assembled geodesic shaped shelter
2—structural panel
3—reinforced panel
4—light-transmitting panel
5—entrance structure
6—vent
7—user
8—elongated clips

DETAILED DESCRIPTION OF PREFERRED EMBODIMENTS

Figure 1:
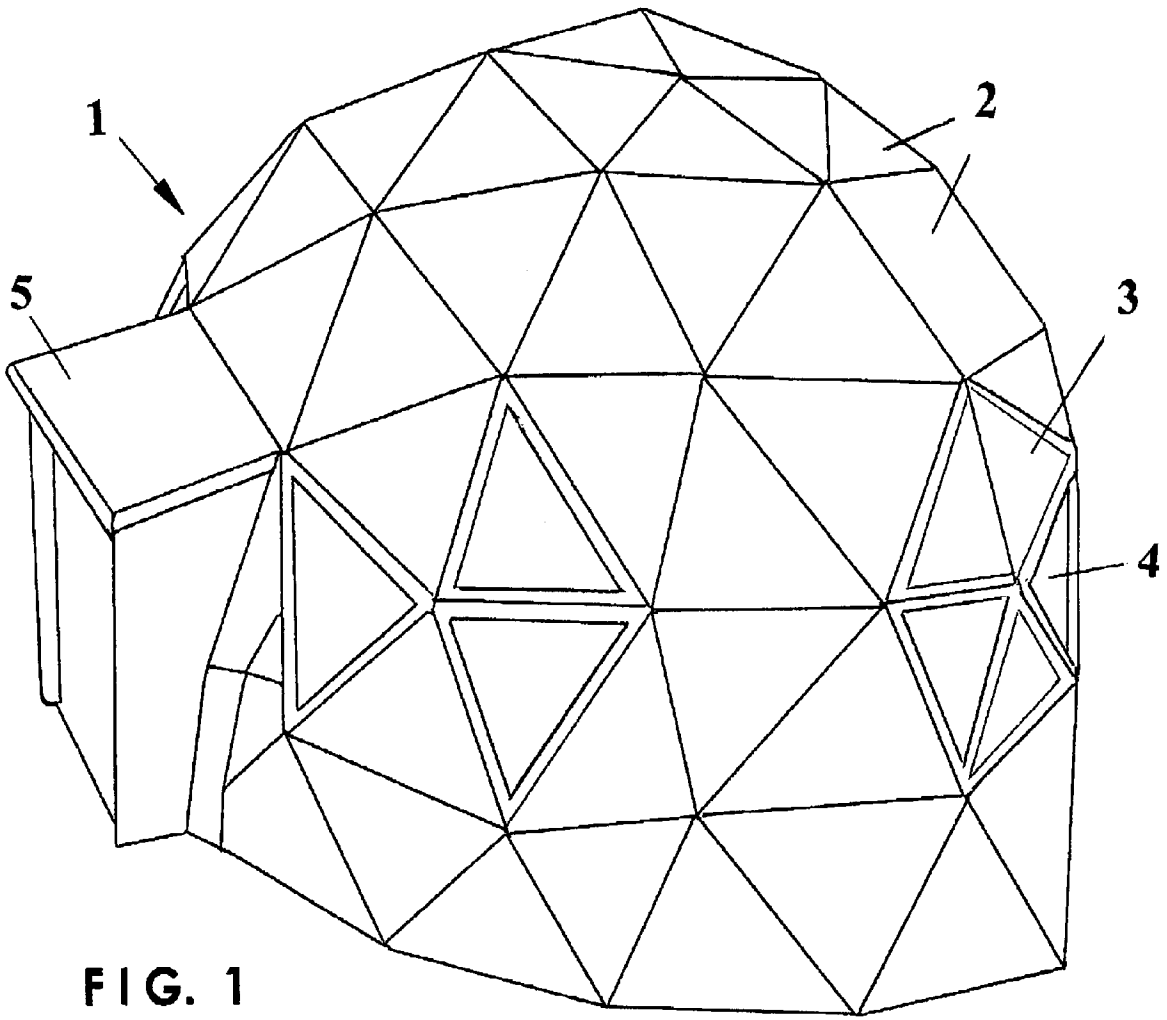
FIG. 1 is a perspective view from the side of the most preferred embodiment of the present invention geodesic dome shelter having structural panels, reinforced panels, light-transmitting panels, and an entrance structure.
Figure 2:
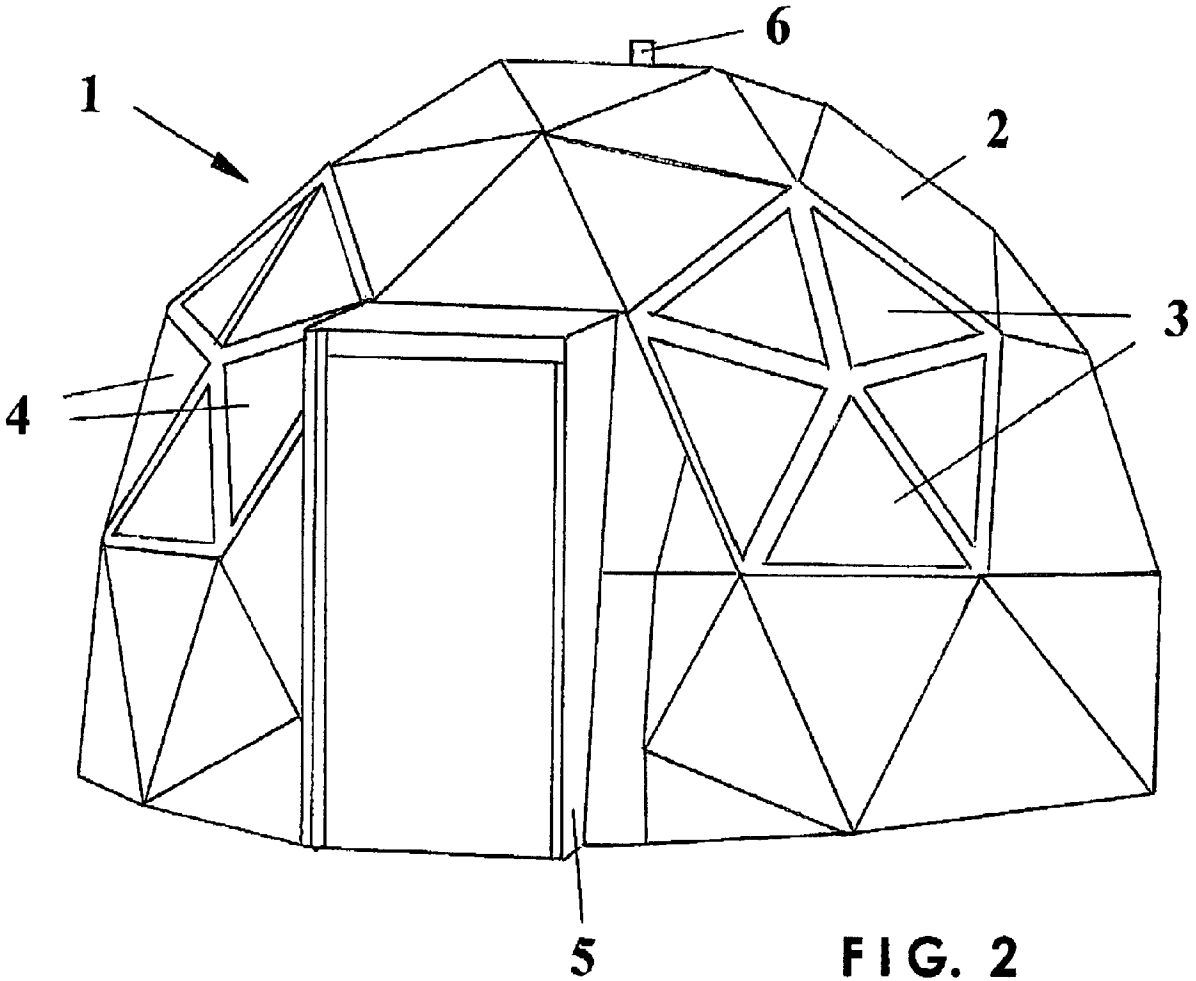
FIG. 2 is a perspective view from the front of the most preferred embodiment of the present invention geodesic dome shelter similar to that shown in FIG. 1, but also showing one top vent.
Figure 3:
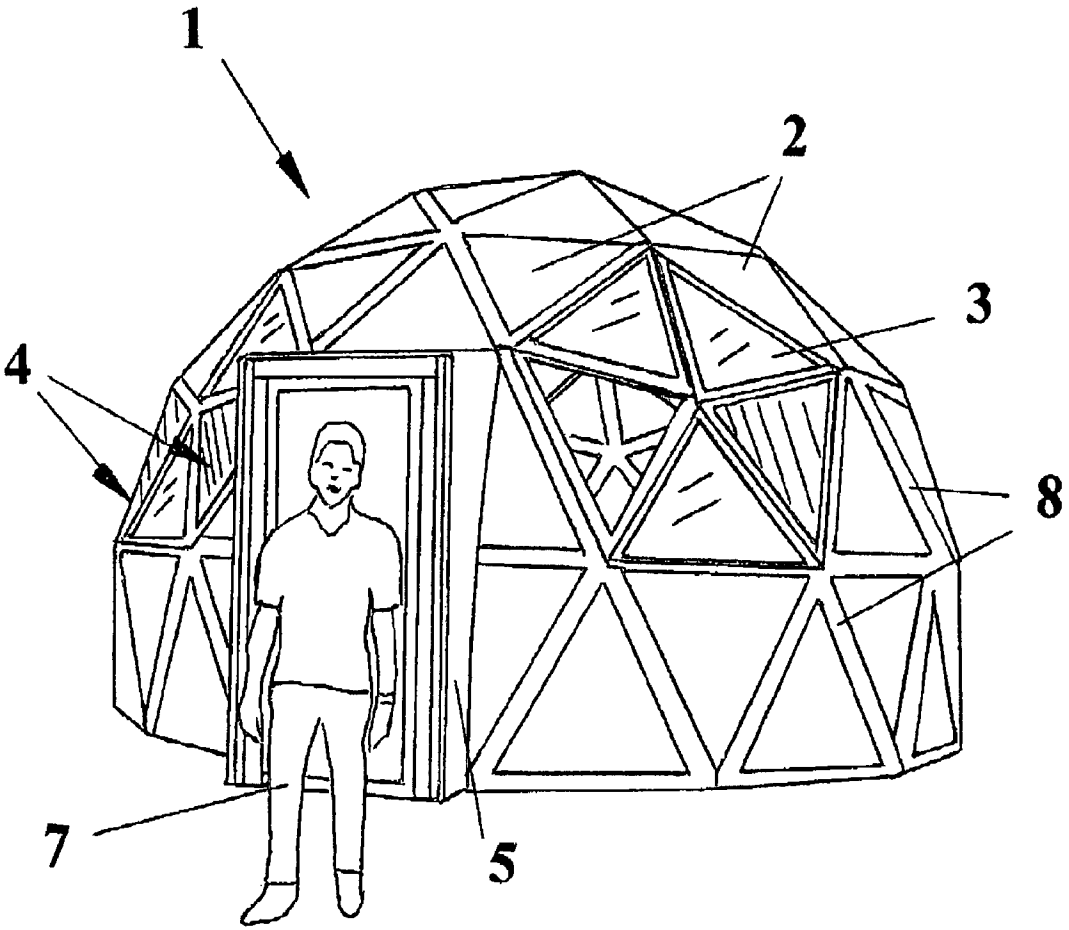
FIG. 3 is a perspective view from the front of the most preferred embodiment of the present invention geodesic dome shelter shown in FIG. 2 with a user placed in front thereof for size comparison purposes.

FIGS. 1-3 show differing views of the most preferred embodiment of the present invention geodesic shaped dome shelter 1 for use in emergencies and disaster relief. It can be a temporary or permanent shelter, and it is in kit form having extruded interlocking panels 2, 3, and 4 that easily clip together to create the general geodesic dome shape. The kits can be stored in a very small space when unassembled, and light-transmitting panels 4, reinforced panels 3, and at least one entrance structure 5 can be used as a part thereof according to need. The sides of panels 2, 3, and 4 can be color-coded for fast and accurate assembly. Also, multiple kits can be can be transported at once by helicopter (not shown) when roads are not available, they are easily and quickly constructed and disassembled, and are made from strong materials that do not mold or burn.

FIG. 1 is a perspective view from the side of the most preferred embodiment of the present invention geodesic dome shelter 1 having structural panels 2, reinforced panels 3, light-transmitting panels 4, and an entrance structure 5. FIG. 2 is a perspective view from the front of the most preferred embodiment of the present invention geodesic dome shelter 1 similar to that shown in FIG. 1, but also showing one top vent 6. More that one vent could be used, and it may vary in size and placement from that shown in FIG. 2. FIG. 3 is a perspective view from the front of the most preferred embodiment of the present invention geodesic dome shelter 1 shown in FIG. 2 with a user 7 placed in front thereof for size comparison purposes. As can be seen in FIG. 3, panels 2, 3, and 4 are planar in construction and positioned next to an adjacent panel 2, 3, or 4 in an edge-to-edge orientation. FIG. 3 also shows clips 8 each having a length dimension equivalent to that of the opposed panel edges that it secures together. To achieve such edge-to-edge connection of adjacent panels 2, 3, or 4, clips 8 require opposed interior longitudinal indentations or notches (one indentation/notch to contain each opposed panel 2, 3, or 4 edge), and the interior of clips 8 would have interior support structure preventing contact of the opposed linear panel edges that it joins together. The number of windows made from light-transmitting panels 4 in each present invention geodesic dome shelter 1 is not critical, and would depend upon its location and intended use. Light-transmitting panels 4 may be transparent, translucent, capable of providing diffused light to the interior of the shelter, or changeable in its light-transmitting capability for better control of interior temperatures. The number and placement of structural panels 2 and reinforced panels 3 in a present invention geodesic dome shelter 1 may also vary from that shown in FIGS. 1-3. Furthermore, the number, configuration, size, and placement of entrance structure 5 should not be considered as limited to that shown in FIGS. 1-3.

For family shelter during emergencies and disaster relief, the United States government currently uses trailers (not shown) each costing between $50,000 and $100,000. Disadvantages of such trailers include their high cost, the large amount of storage space they require when not in use, and the fact that roads are needed to transport them to a disaster site. In contrast, the present invention geodesic dome shelter 1 is in the kit form and compactly stored when not in use. Approximately twenty-four 600-square-foot unassembled present invention geo shelter 1 kits can be stored in the footprint of one U.S. government emergency trailer. Also, each present invention panel 2, 3, or 4 used to assemble one of the geo shelters 1 weighs approximately one-and-one-half pounds, allowing one Blackhawk helicopter (not shown) to lift approximately nine present invention kits (each for assembly of a 600-square foot present invention dome) at once for transport to a disaster site, and the material cost for each present invention geodesic dome shaped shelter 1 is only about twenty percent of that of a new U.S. government emergency trailer. As the present invention panels 2, 3, and 4 clip together, no tools are needed for assembly of the present invention temporary shelters. However, should a panel 2, 3, or 4 need to be removed for repair or replacement, a small tool may be used to pop open the clips holding it in place and release the panel 2, 3, or 4 in need of repair or replacement. In addition, the panels 2, 3, and 4 are preferably made from strong interlocking composite and extrusion materials that do not mold or burn, such as but not limited to fiberglass, an advantage over the U.S. government trailers, and it only takes about two hours to open a present invention shelter 1 kit and assemble an approximately 600-square-foot shelter. Although the example used throughout this disclosure is an approximately 600-square-foot present invention shelter 1, it is also possible and considered a part of this invention for shelters 1 to have sizes larger and smaller than 600-square-feet. Although present invention geodesic dome shaped shelters 1 can be used as a source of temporary housing, they can also be constructed on an appropriate foundation and used as permanent housing. No other temporary shelter for emergencies and disaster relief is known that functions in the same manner as the present invention, has the same structure disclosed herein, or provides all of its important advantages.

I claim:

1. A low cost shelter which capable of being assembled without tools and also disassembled by use of a prying tool, said shelter comprising a plurality of extruded interlocking panels each with at least three edges and a plurality of elongated clips each having a minimum length dimension equivalent to that of one of said at least three edges, said clips also configured to join adjacent ones of said interlocking panels together in edge-to-edge orientation without adjacent ones of said joined edges having direct contact with one another, creating the shape of a geodesic dome, said clips allowing adjacent ones of said interlocking panels to remain together in the shape of a geodesic dome until at least one of said clips is released by a prying tool.

2. The shelter of claim 1 wherein said extruded interlocking panels and said clips together form a minimum 600-square-ft of living space.

3. The shelter of claim 1 wherein said extruded interlocking panels are color-coded for fast and accurate assembly into the shape of a geodesic dome.

4. The shelter of claim 1 wherein some of said extruded interlocking panels are light-transmitting panels.

5. The shelter of claim 1 wherein some of said extruded interlocking panels are reinforced panels.

6. The shelter of claim 1 further comprising at least one entrance structure.

7. The shelter of claim 1 wherein said extruded interlocking panels are made from composite materials that do not mold or burn.

8. The shelter of claim 1 further comprising at least one top vent.

* * * * *